United States Patent [19]

Kilsdonk

[11] 4,181,391

[45] Jan. 1, 1980

[54] POLARIZED ELECTRICAL CONNECTOR

[75] Inventor: Jan A. Kilsdonk, Corona, Calif.

[73] Assignee: International Telephone and Telegraph Corporation, New York, N.Y.

[21] Appl. No.: 932,345

[22] Filed: Aug. 9, 1978

[51] Int. Cl.[2] ..... H01R 13/64

[52] U.S. Cl. ..... 339/92 M; 339/184 M

[58] Field of Search ..... 339/92 R, 92 M, 184 R, 339/184 M, 186 R, 186 M, 92, 184, 186

[56] References Cited

U.S. PATENT DOCUMENTS

| | | | |
|---|---|---|---|
| 3,555,491 | 1/1971 | Moss | 339/184 R |
| 3,582,867 | 6/1971 | Thompson et al. | 339/184 M |

*Primary Examiner*—Neil Abrams

*Attorney, Agent, or Firm*—A. Donald Stolzy

[57] ABSTRACT

A permanent or detachable assembly to pull an electrical plug and receptacle into a mated position including, for example, preferably two jackscrews positioned through flanges on the plug and receptacle at opposite ends thereof, the jackscrews having surrounding keying devices which prevent plug and receptacle mating if not aligned. For example, the keying devices may be mounted to corresponding flanges in one of six positions. This makes it possible to allow one and only one plug out of six to mate with a corresponding receptacle. Thus, a wrong connection between a plug and a receptacle is impossible when no more than six types of connections are provided. However, other connections and/or positions are possible.

1 Claim, 3 Drawing Figures

POLARIZED ELECTRICAL CONNECTOR

BACKGROUND OF THE INVENTION

This invention relates to electrical connectors, and more particularly to means for mating or unmating a plug and a receptacle.

PRIOR ART STATEMENT

Jackscrews have been used in the prior art to mate electrical connectors. However, most of these are unwieldy, large and expensive. They also have limited polarizing capability.

It is another disadvantage of prior art jackscrews that they cannot be assembled in the field.

SUMMARY OF THE INVENTION

In accordance with the electrical connector assembly of the present invention, the above-described and other disadvantages of the prior art are overcome by providing a jack screw with keying devices having a plurality of positions to allow only corresponding plugs and receptacles to be mated.

The assembly of the present invention is small and inexpensive. It can also be polarized to fit together in only one of a large number of positions. It also can be used in the field.

BRIEF DESCRIPTION OF THE DRAWINGS

In the accompanying drawings which illustrate exemplary embodiments of the invention.

DESCRIPTION OF THE PREFERRED EMBODIMENT

Figure 1:
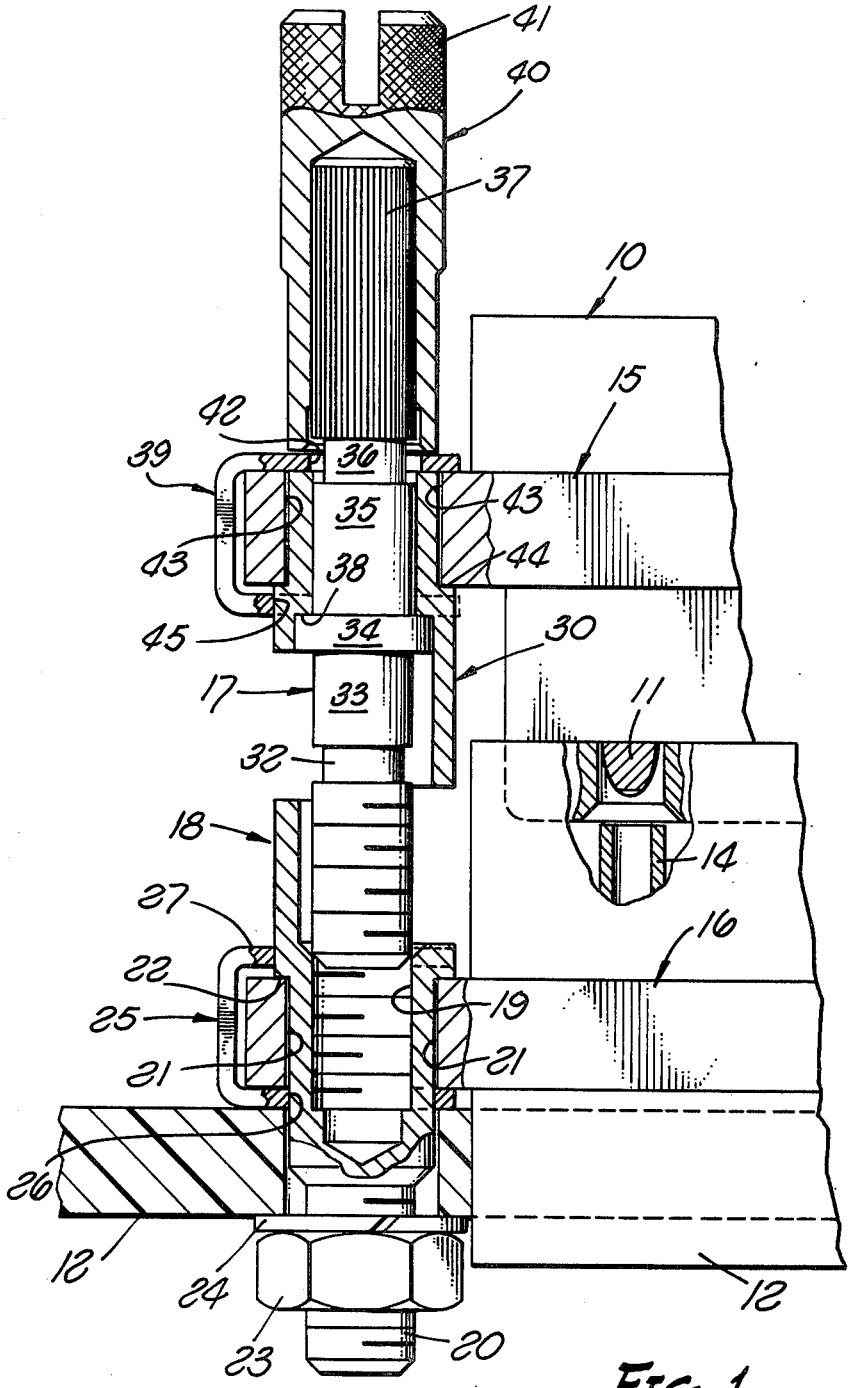
FIG. 1 is a vertical sectional view, partly in elevation, of the assembly of the present invention.

In FIG. 1, a plug is shown at 10 having pins, one typical pin being indicated at 11.

A printed circuit board is shown at 12. Printed circuit board 12 may be omitted whenever desired.

Printed circuit board 12 is positioned next to a receptacle 13 having a typical one 14 of a plurality of sockets to mate with a plurality of pins such as pin 11 in plug 10.

Plug 10 has a flange 15 which is rectangular in plan (not shown). Receptacle 13 has a flange 16 which may, if desired, be identical to flange 14. A jackscrew 17 is provided centrally of each end of flanges 15 and 16, only one jackscrew 17 being shown in FIG. 1.

The structures shown in FIG. 1 may be assembled as follows. A keying device is provided at 18 which extends around the axis of jackscrew 17 180°. Keying device 18 has an internal thread at 19 and an external thread at 20. Flange 16 has a hole 21 therethrough through which device 18 is inserted, as shown. Device 18 has a shoulder 22 which abuts the upper surface of flange 16.

Device 18 is pulled tight to flange 16 and printed circuit board 12 by a nut 23 threaded at 20 and a lock washer 24.

A U-shaped clip 25 straddles flange 16. Clip 25 has a circular hole therethrough at 26 through which device 18 projects. Clip 25 has a leg 27 that prevents device 18 from rotating. This construction may be better understood from FIG. 3.

Figure 3:
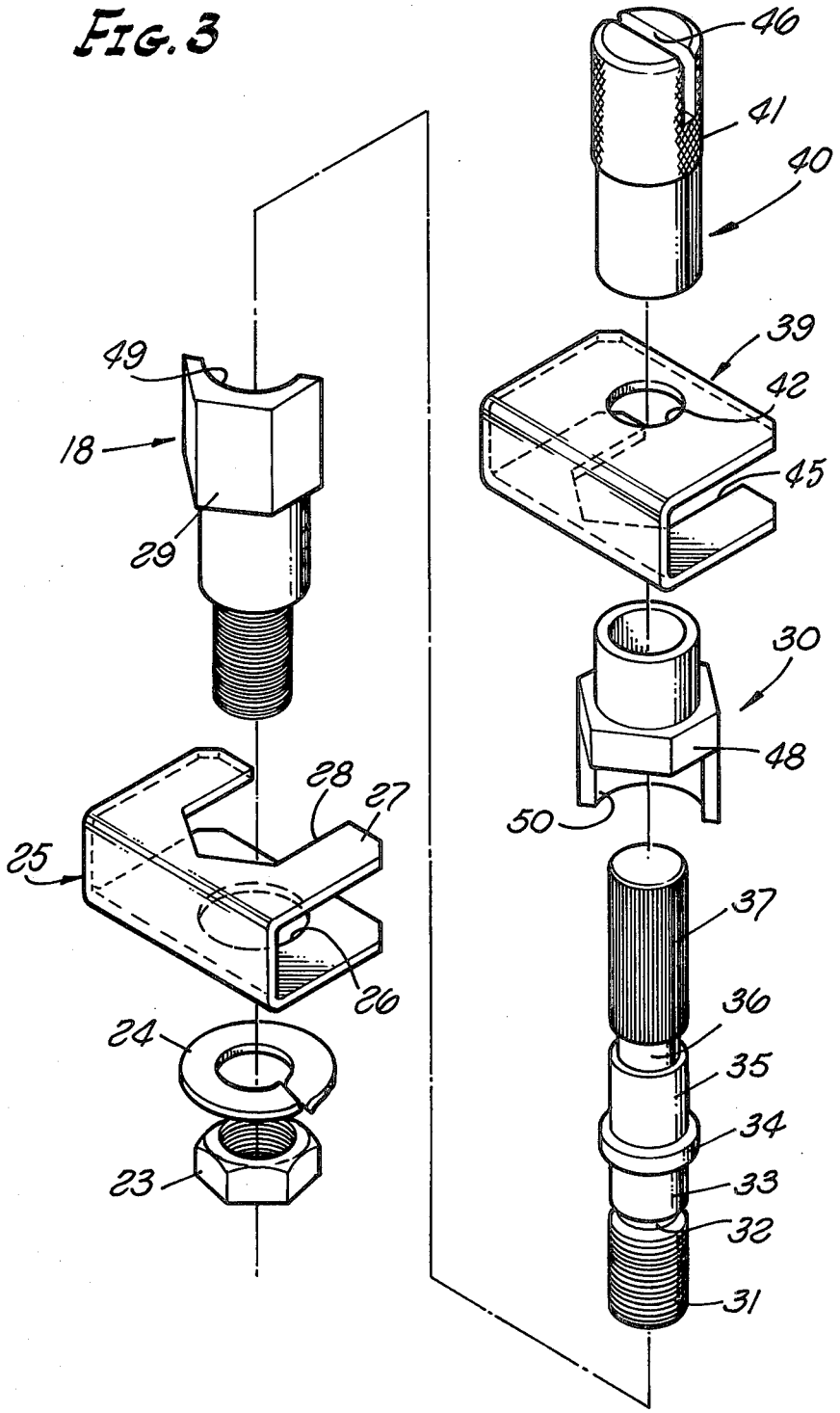
FIG. 3 is an exploded perspective view of most of the parts of the assembly shown in FIG. 1.

In FIG. 3, clip 25 has a slot 28 to fit four sides of the hexagon-shaped outer surface of device 18 indicated at 29.

To pull plug 10 and receptacle 13 into mated positions, (FIG. 1) jackscrew 17 is rotated. A device 30 is provided which also extends 180° around jackscrew 17. If devices 18 and 30 are disposed on opposite sides of the axis of jackscrew 17, jackscrew 17 may be threaded at 31 into device 18 at 19. If devices 18 and 30 are not properly keyed, jackscrew 17 cannot be threaded into device 18 at 19. By these means, it is possible to have, for example, a plurality of identical plugs 10 and a plurality of identical receptacles 13. Each plug and receptacle may be constructed to be mated with a corresponding receptacle, but not with all the receptacles. Thus, even though plugs 10 and receptacles 13 may be identical, they may be connected to different circuits. Each plug may then be or should be connected to a particular one receptacle. By mounting devices 18 and 30 properly, it is then possible to keep an assembler from mating a plug with the wrong receptacle.

The assembly around flange 15 is similar to that around flange 16. Jackscrew 17 has a reduced diameter portion 32, another diameter portion 33, a flange 34, another portion 35, another reduced portion 36 and a portion 37 with a medium straight knurl. The portions of jackscrew 17 just described extend upwardly from threaded portion 31 as viewed in FIG. 1. Flange 34 abuts an internal shoulder 38 on device 30 and keeps device 30 abutting the lower surface of a clip 39 similar to clip 25. Downward movement of jackscrew 17 is limited to the position of flange 15, more or less, by a jack nut 40 which may be press fit on portion 37 in a permanent or removable manner, the external surface of jack nut 40 having a medium diamond knurl at 41.

As before, clip 39 has a hole 42 therethrough to accommodate jackscrew 17.

Movement of device 30 upwardly through a hole 43 in flange 15 is prevented by a shoulder 44 on device 30.

As before, clip 39 has a slot 45 therein to prevent rotation of device 30.

Figure 2:
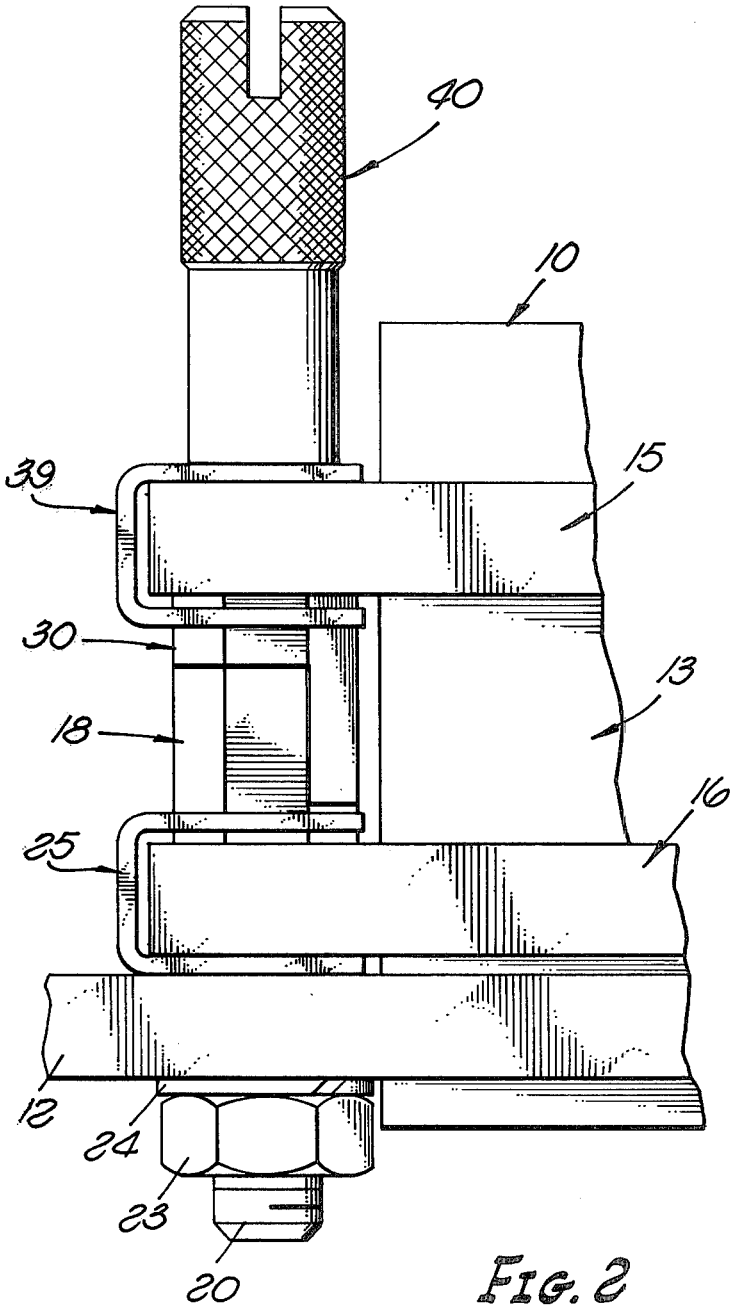
FIG. 2 is a broken-away side elevational view of the assembly shown in FIG. 1.

Plug 10 and receptacle 13 are shown mated in FIG. 2. Jackscrew 17 may be rotated manually by the use of the fingers at portion 40 shown in FIG. 3. Alternatively, a screwdriver may be applied to slot 46 shown in FIG. 3. In a manner similar to that described in connection with clip 25, in FIG. 3 clip 39 is slotted at 45 to engage three of the hexagon sides 48 of device 30. Note will be taken that the internal surface of device 18 is half cylindrical at 49 and that the same is true of device 30 at 50.

What is claimed is:

1. An electrical connector assembly comprising: a plug having a flange with a hole therethrough, said plug flange hole having an axis; a receptacle having a flange with a hole therethrough coaxial with said plug flange hole; a first U-shaped clip straddling said plug flange; a second U-shaped clip straddling said receptacle flange, said flanges having flat portions in an axial direction adjacent respective holes therethrough, said first and second clips having flat portions contiguous to those of said plug and receptacle, respectively; a first keying device having a hollow cylindrical first shank fitted contiguous to and inside said plug flange hole, said first keying device having a hollow tube with a polygonal external surface with a maximum cross section greater than that of the outside diameter of said first shank and abutting said plug flange on the side thereof facing said receptacle flange, said first clip having first and second legs, said first leg having an axial hole aligned with said plug flange hole, said second leg having a slot to conform to said first keying device polygonal surface and to keep said first keying device from rotating; a shaft extending through said first shank and said first clip hole to a point above said first clip; rotation means fixed to said shaft above said plug flange to turn said shaft and to hold said shaft above said flange, said shaft having a flange to abut said first keying device to prevent axial movement thereof, said shaft having a lower threaded end; a second keying device having a hollow internally threaded cylindrical second shank fitted contiguous to and inside said receptacle flange hole; and releasable means to hold said second keying device in a fixed axial position relative to said receptacle flange, said shaft being capable of being threaded into said second shank, said second keying device having a hollow tube with a polygonal surface, said second clip being similar in construction to said first clip and having a second leg with a slot to conform to the polygonal surface of said second keying device, said tubes having 180 degree notches and being turned 180 degrees relative to each other so that they can move vertically without abutting, threading of said shaft into said second shank causing said plug and receptacle to mate.

* * * * *